US009368900B2

(12) United States Patent
Lai

(10) Patent No.: US 9,368,900 B2
(45) Date of Patent: Jun. 14, 2016

(54) POWER SOCKET STRUCTURE FOR OUTDOOR ELECTRIC EXTENSION LINE

(71) Applicant: Li-Chun Lai, New Taipei (TW)

(72) Inventor: Li-Chun Lai, New Taipei (TW)

( * ) Notice: Subject to any disclaimer, the term of this patent is extended or adjusted under 35 U.S.C. 154(b) by 47 days.

(21) Appl. No.: 14/478,167

(22) Filed: Sep. 5, 2014

(65) Prior Publication Data

US 2016/0072215 A1 Mar. 10, 2016

(51) Int. Cl.

| | |
|---|---|
| ***H01R 13/44*** | (2006.01) |
| ***H01R 13/516*** | (2006.01) |
| ***H01R 13/447*** | (2006.01) |
| ***H01R 13/512*** | (2006.01) |
| ***H01R 25/00*** | (2006.01) |

(52) U.S. Cl.

CPC ..... *H01R 13/516* (2013.01); *H01R 13/447* (2013.01); *H01R 13/512* (2013.01); *H01R 25/006* (2013.01)

(58) Field of Classification Search

CPC .. H01R 13/516; H01R 13/447; H01R 13/512; H01R 25/006; H01R 35/00

USPC ..... 439/142, 138

See application file for complete search history.

(56) References Cited

U.S. PATENT DOCUMENTS

2014/0148024 A1* 5/2014 Lai ..... H01R 25/006 439/135

* cited by examiner

*Primary Examiner* — Javaid Nasri

(74) *Attorney, Agent, or Firm* — Ming Chow; Sinorica, LLC

(57) ABSTRACT

A power socket structure for outdoor electric extension line is disclosed, comprising one or more power sockets, a socket body including a first pivotal axis and a second pivotal axis, a fixation case and a cone, wherein the cone is fixedly combined with at least a sidewall of the fixation case, and the socket body is pivotally connected onto the fixation case such that the socket body can rotate within the fixation case. Upon inserting a power plug of an electric product into the power socket, the power plug can bring the socket body to rotate within the fixation case so that the power socket of the socket body always faces towards the electric product thereby preventing the product power line of the power plug from wrapping around the socket body which may otherwise cause troublesome power line entanglements.

8 Claims, 9 Drawing Sheets

POWER SOCKET STRUCTURE FOR OUTDOOR ELECTRIC EXTENSION LINE

BACKGROUND OF THE INVENTION

1. Field of the Invention

The present invention generally relates to a power socket structure for outdoor electric extension line; in particular, it relates a power socket for outdoor use which is capable of rotating along with the rotation of a power plug thereby preventing connection line tangling or damages due to repetitive rotations of the power plug in case that the power socket is unable to rotate.

2. Description of Related Art

Extension line electric power sockets are comprehensively used in people's daily lives because they can solve the issue about insufficient number of power sockets in a house or office which may be annoying for electrical devices applications, thus that such extension line electric power sockets can be found almost everywhere.

Since the outdoor extension line power socket may be required to be placed outdoor in order to provide outdoor electric products with electric power, for users needing long-term outdoor power supply, the extension line power socket would be inevitably disposed outdoors for a long duration of time. When a user operates an electric product, it may not be fixedly placed at a certain location, so the user probably has to move it which may cause the product power line of the electric product inserted on the extension line power socket starts to entangle and tie around the extension line power socket. Accordingly, such repetitive rotations to the product power line of the electric product may finally cause damages or even fracture problems in the internal conductive line thereof due to power line entanglement, thus resulting in a broken or unusable product power line; hence, it may eventually become a big trouble for the user if this problem can not be well resolved.

Based on such points, it would be an optimal solution suppose, when the position of the electric product is changed, the extension line power socket can also move correspondingly such that it can always face towards the electric product, and as a result such repetitive rotations to the product power line of the electric product which tend to cause damages or even fractures in the internal conductive line thereof can be effectively avoided.

SUMMARY OF THE INVENTION

The present invention provides a power socket structure for outdoor electric extension line, comprising a socket body having one or more power sockets, and when an electric product connected thereto is moved, the socket body can be brought to rotate along with the power plug of the power line connected to the electric product such that the power socket of the socket body always faces towards the electric product; in this way, such rotations to the power line of the electric product which tend to eventually cause damages or even fracture issues in the internal conductive line thereof can be effectively avoided.

The power socket structure for outdoor electric extension line in accordance with the present invention for successfully achieving the aforementioned objectives comprises: a socket body, including one or more power sockets, in which the top of the case of the socket body has a first pivotal axis, and the edge of the first pivotal axis is installed with a blocker, while the bottom of the case of the socket body has a hollow second pivotal axis, and the edge of the second pivotal axis is installed with a blocker, and a power line electrically connected to the socket body extends out and outputs electric power from the hollow second pivotal axis; a fixation case, including a first side case and a second side case, thus forming a recess positioning part through combining the first side case and the second side case, in which the top surface of the positioning part is installed with a pivotal connection hole, while the bottom surface thereof installed with a pivotal connection structure thereby allowing a combination with the socket body to be accommodated within the positioning part, such that the first pivotal axis of the socket body is pivotally connected to the pivotal connection hole on the top of the positioning part, and the second pivotal axis is pivotally connected to the pivotal connection structure on the bottom of the positioning part, thus maintaining the socket body in position through the blockage and holding by the blockers on the edges of the first pivotal axis and the second pivotal axis and allowing rotations brought by a power plug in the positioning part of the fixation case, and also one of the sidewalls in the fixation case is installed with a screw hole; and a cone, joined in screw with the screw hole in the fixation case such that the cone can be located on a sidewall of the socket body, in which the cone is to be implanted into ground so that the fixation case pivotally connected with the socket body can be steadily positioned for outdoor applications.

More specifically, the first side case and the second side case both include a recess space for forming the positioning part upon combining, and also the tops of the first side case and the second side case include a half recess pivotal connection orifice for forming the closed pivotal connection hole upon combining.

More specifically, the blocker on the edge of the first pivotal axis presses against the outer side of the pivotal connection orifice on the top of the first side case and the top of the second side case.

More specifically, the surface on the second pivotal axis of the socket body includes one or more elastic plates, and the pivotal connection structure of the fixation case includes a recess/protrusion positioning surface such that the socket body can be limited in position by the recess/protrusion positioning surface while rotating, thus allowing a segmental positioning feature.

More specifically, both the first side case and the second side case have a recess space for forming the positioning part upon combining, and also both the bottoms of the first side case and the second side case include a three-layered recess orifice structure for forming the pivotal connection structure upon combining, in which the three-layered recess orifice structure includes sequentially a first layer recess orifice structure, a second layer recess orifice structure as well as a third layer recess orifice structure, and the second layer recess orifice structure has at least one recess/protrusion positioning surface.

More specifically, the blocker on the edge of the second pivotal axis presses against the inner side of the third layer recess orifice structure in the three-layered recess orifice structure on the bottom of the first side case and the bottom of the second side case.

More specifically, the blocker of the second pivotal axis presses against and holds steady the inner side on the bottom of the pivotal connection structure, at least a protrusion plate extends from the edge of the blocker on the second pivotal axis, and the bottom of the pivotal connection structure includes at least a position-limiting part such that, as the socket body rotating, the protrusion plate can be blocked by the position-limiting part so the rotation of the socket body is only allowed within a confined range.

More specifically, each power socket on the socket body is installed with a protection lid which can be used to cover or expose the power socket.

DETAILED DESCRIPTION OF THE PREFERRED EMBODIMENTS

The aforementioned and other technical contents, aspects and effects in relation with the present invention can be clearly appreciated through the detailed descriptions concerning the preferred embodiments of the present invention in conjunction with the appended drawings.

Figure 1:
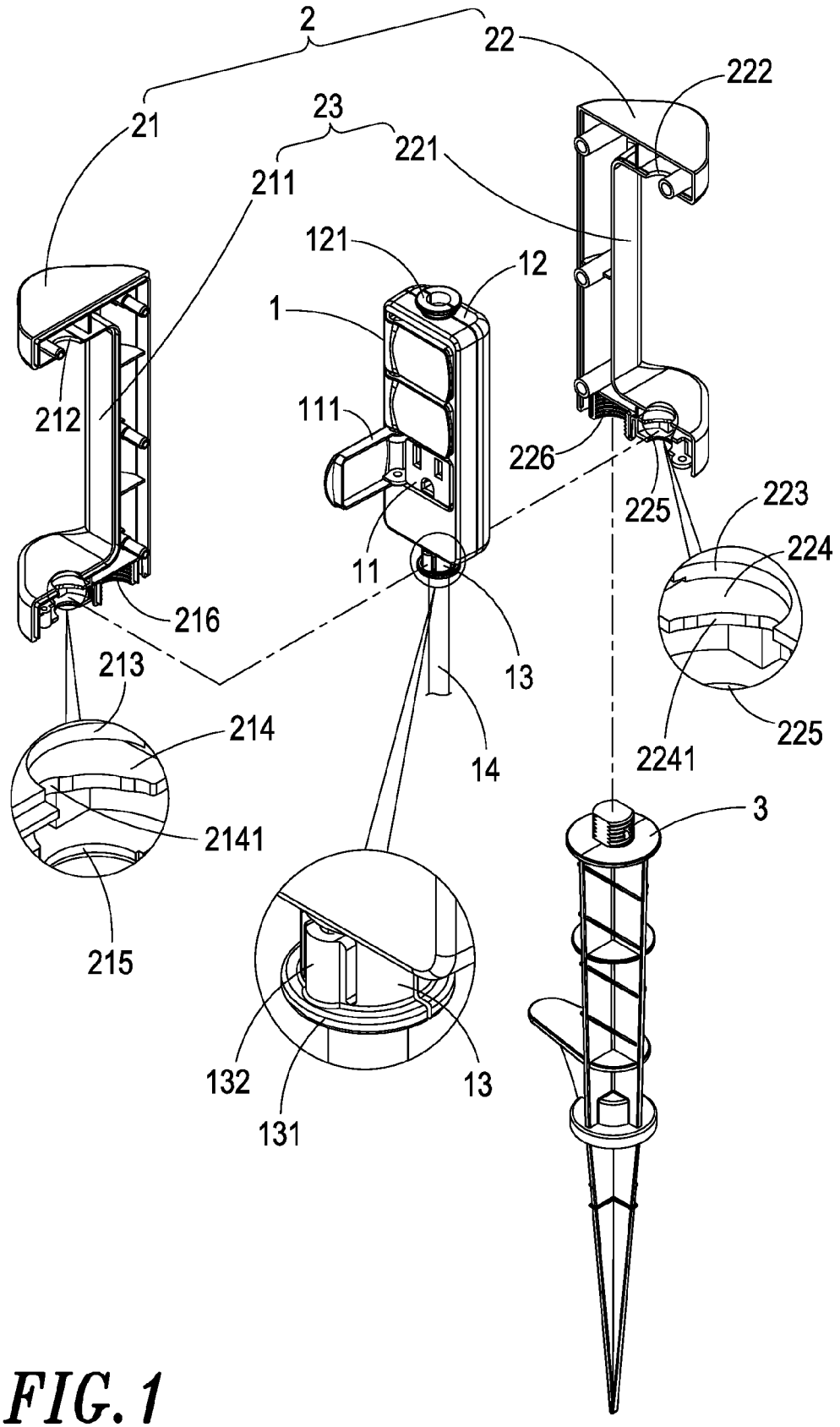
FIG. 1 shows a disassembled structure view for a first embodiment of the power socket structure for outdoor electric extension line according to the present invention.
Figure 2:
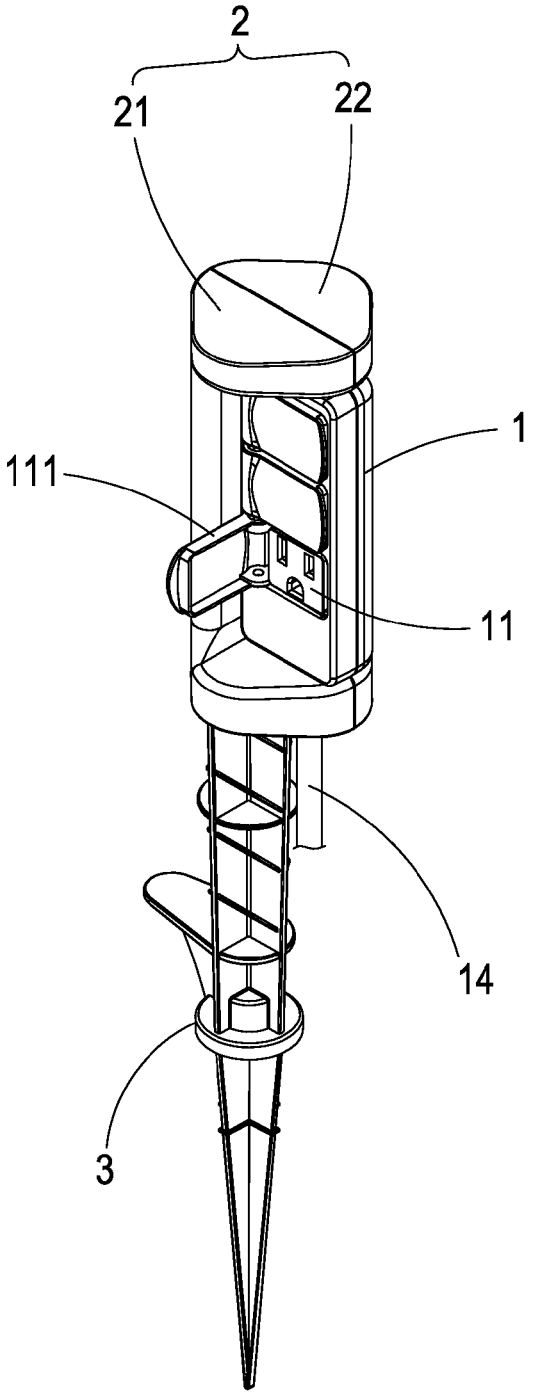
FIG. 2 shows an assembled structure view for the first embodiment of the power socket structure for outdoor electric extension line according to the present invention.

Refer now to FIGS. 1 and 2, wherein a disassembled structure view and an assembled structure view for a first embodiment of the power socket structure for outdoor electric extension line according to the present invention is respectively shown. It can be seen from the Figures that the power socket structure for outdoor electric extension line comprises a socket body 1, a fixation case 2 and a cone 3, wherein the socket body 1 includes one or more power sockets 11, and each of the power sockets 11 can be optionally installed with a protection lid 111 based on demand for shielding or exposing the power socket 11 thereby preventing possible power leakage or electric shock hazards. Moreover, the top of the case of the socket body 1 has a first pivotal axis 12, and the edge of the first pivotal axis 12 is installed with a blocker 121, while the bottom of the case of the socket body 1 has a hollow second pivotal axis 13, and the edge of the second pivotal axis 13 is installed with a blocker 131; herein a power line 14 electrically connected to the socket body 1 extends out from the hollow second pivotal axis 13 such that an alternative current (AC) power source can be fed into the socket body 1 thus enabling the power socket 11 of the socket body 1 to output AC power.

From FIG. 1, it can be appreciated that the fixation case 2 includes a first side case 21 and a second side case 22, with each of the first side case 21 and the second side case 22 having respectively a recess space 211, 221 thereby forming a recess positioning part after combining the first side case 21 and the second side case 22. The combination of the first side case 21 and the second side case 22 can be accomplished by way of adhesive bonding or screw joining; in the present embodiment, it is done through a combination of a plug-in element and a plug-in hole, and then fixedly locked through with a screw bolt.

FIG. 1 also shows that both the tops of the first side case 21 and the second side case 22 include a half recess pivotal connection orifice 212, 222 for forming the closed pivotal connection hole upon combining. Moreover, both the bottoms of the first side case 21 and the second side case 22 include a three-layered recess orifice structure for forming the pivotal connection structure upon combining, in which the three-layered recess orifice structure includes sequentially a first layer recess orifice structure 213, 223, a second layer recess orifice structure 214, 224 as well as a third layer recess orifice structure 215, 225, and the edge of the second layer recess orifice structure 214, 224 includes at least one recess/protrusion positioning surface 2141, 2242.

Besides, from FIG. 1, it can be seen that a half recess screw hole 216, 226 is configured on the sidewalls of the first side case 21 and the second side case 22. Upon joining the fixation case 2 onto the socket body 1, a screw hole can be formed which allows the cone 3 to be fixed with screw onto the fixation case 2 and also allows the cone 3 to be located on a sidewall periphery of the socket body 1 such that the cone 3 and power line 14 of the socket body can be set up in parallel.

Figure 3:
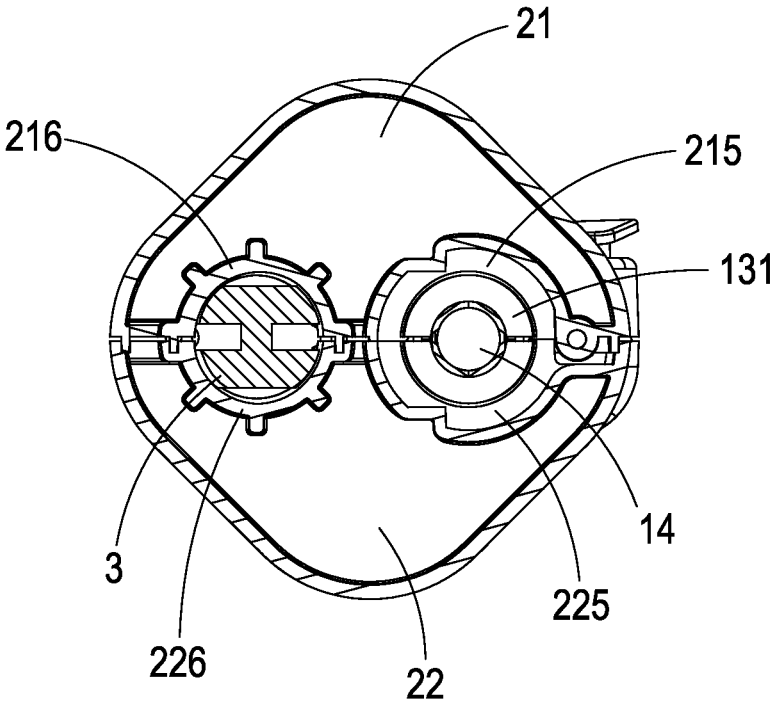
FIG. 3 shows a bottom cross-section structure view for the first embodiment of the power socket structure for outdoor electric extension line according to the present invention.

From FIG. 3, it can be appreciated that, after assembling the socket body 1, the fixation case 2 and the cone 3, the blocker 131 on the edge of the second pivotal axis 13 can press against the inner side of the third recess orifice structure 215, 225 in the three-layered recess orifice structure on the bottom of the first side case 21 and the bottom of the second side case 22 (while the blocker 131 of the second pivotal axis 13 does not expose from the outer side of the third layer recess orifice structure 215, 225.) In addition, the blocker 121 on the edge of the first pivotal axis 12 presses against the outer side of the pivotal connection orifice on the tops of the first side case 21 and the top of the second side case 22.

Figure 4:
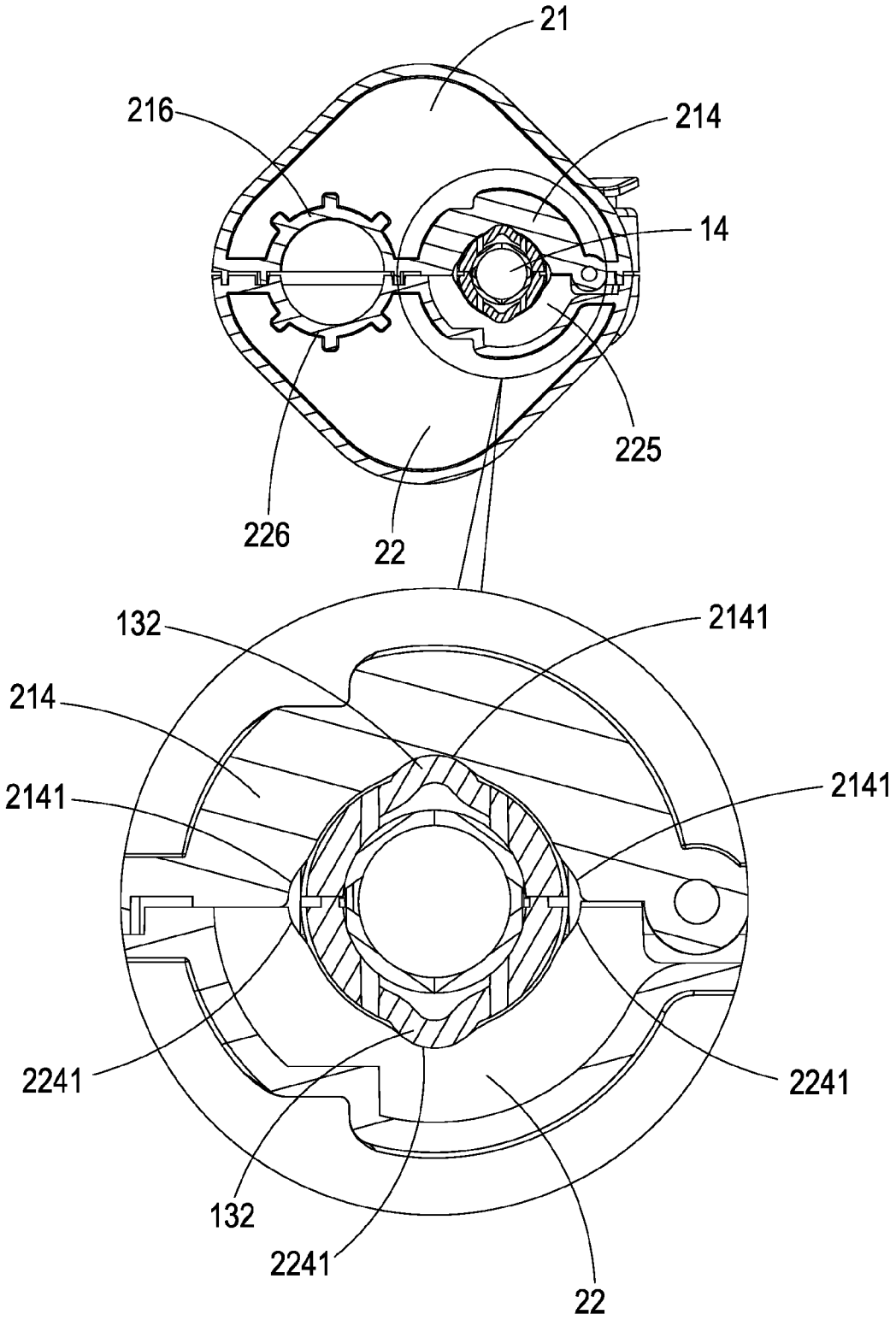
FIG. 4 shows an enlarged structure view for the socket body and the fixation case of the power socket structure for outdoor electric extension line according to the present invention.

From FIG. 4, it can be observed that the surface of the second pivotal axis 13 in the socket body 1 includes one or more elastic plate 132 offering elasticity and stretchable feature. Hence, after combining the socket body 1, the fixation case 2 and the cone 3, the location of the elastic plate 132 is in correspondence with the positions of the second layer recess orifice structure 214, 224 and the third layer recess orifice structure 215, 225. Since the second layer recess orifice structure 214, 224 includes at least one recess/protrusion positioning surface 2141, 2242, when the socket body 1 rotates inside the positioning part of the fixation case 2, it can be limited in position by the recess/protrusion positioning surface 2141, 2242 thereby providing a segmental positioning feature; in this way, the socket body 1 can be stabilized in order to eliminate the situations of swaying or instability due to repetitive rotations.

Figure 5:
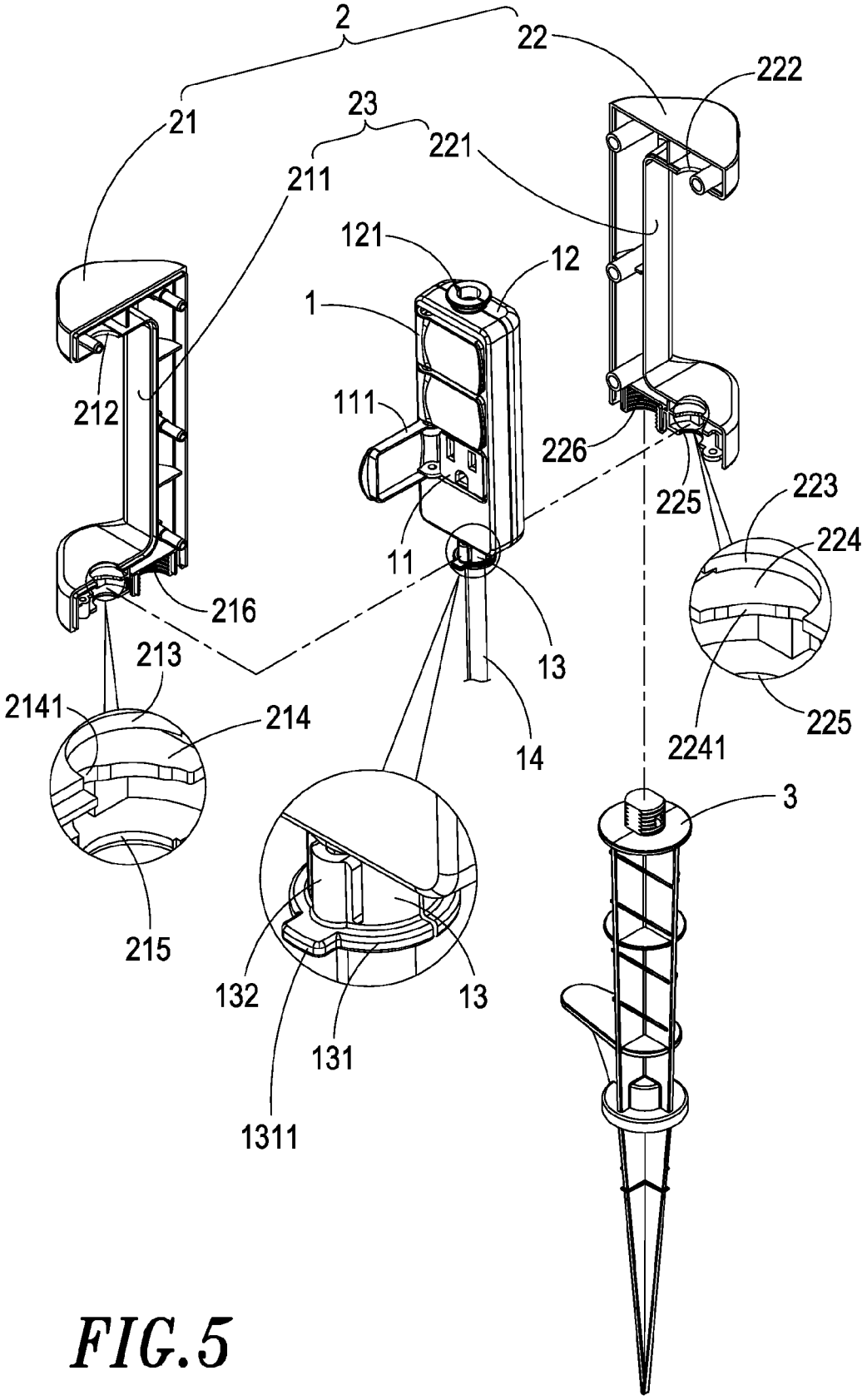
FIG. 5 shows a disassembled structure view for a second embodiment of the power socket structure for outdoor electric extension line according to the present invention.
Figure 6:
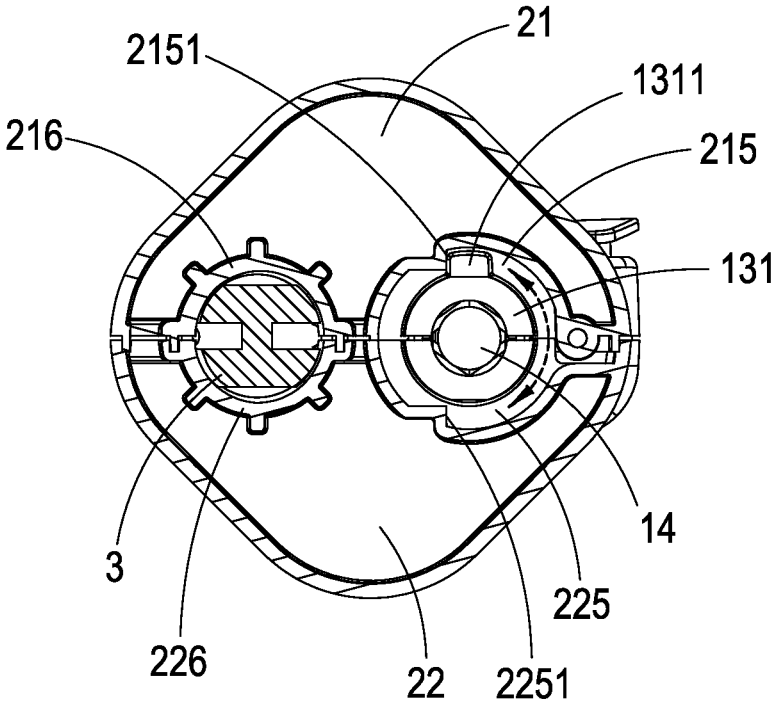
FIG. 6 shows a bottom cross-section structure view for the second embodiment of the power socket structure for outdoor electric extension line according to the present invention.

Next, FIG. 5 shows a disassembled structure view for a second embodiment of the power socket structure for outdoor electric extension line according to the present invention. The difference between the present embodiment and the first embodiment lies essentially in that at least a protrusion plate 1311 extends from the edge of the blocker 131 on the second pivotal axis 13. Herein, after assembling the socket body 1, the fixation case 2 and the cone 3, since the blocker 131 on the edge of the second pivotal axis 13 presses against the inner side of the third layer recess orifice structure 215, 225 in the three-layered recess orifice structure on the bottom of the first side case 21 and the bottom of the second side case 22, it can be clearly seen from FIG. 5 that a position limiting part is configured in recess between the second layer recess orifice structure 214, 224 and the third layer recess orifice structure 215, 225; therefore, when the socket body 1 rotates in the positioning part of the fixation case 2, as shown in FIG. 6, the blocker 131 of the second pivotal axis 13 will also rotate in the third layer recess orifice structure 215, 225 towards the surface of the second layer recess orifice structure 214, 224. Because of the position limiting part designed between the second layer recess orifice structure 214, 224 and the third layer recess orifice structure 215, 225, upon rotating to a certain angle, the position limiting part can block the protrusion plate 1311 such that the socket body can rotate simply within a confined range (in the present embodiment, as shown in FIG. 4, the elastic plate 132 can maintain the steadiness of the socket body 1.) In the present embodiment, the available rotation angle of the socket body 1 covers only 180°, while in the first embodiment in absence of the protrusion plate 1311, the socket body 1 can operate with a 360° rotation.

Figure 7A:
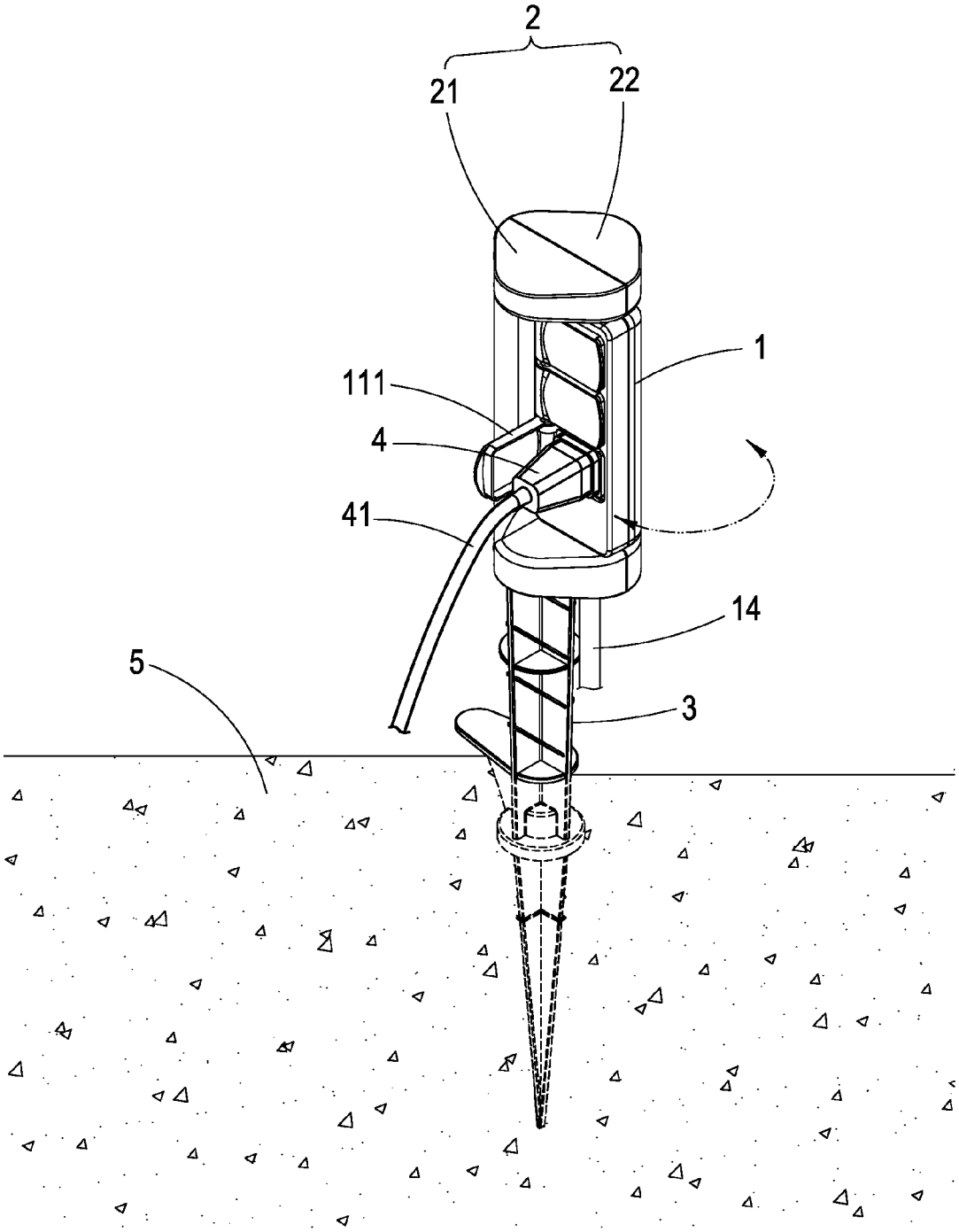
FIG. 7A shows a view for the rotation implementation of the power socket structure for outdoor electric extension line according to the present invention.
Figure 7B:
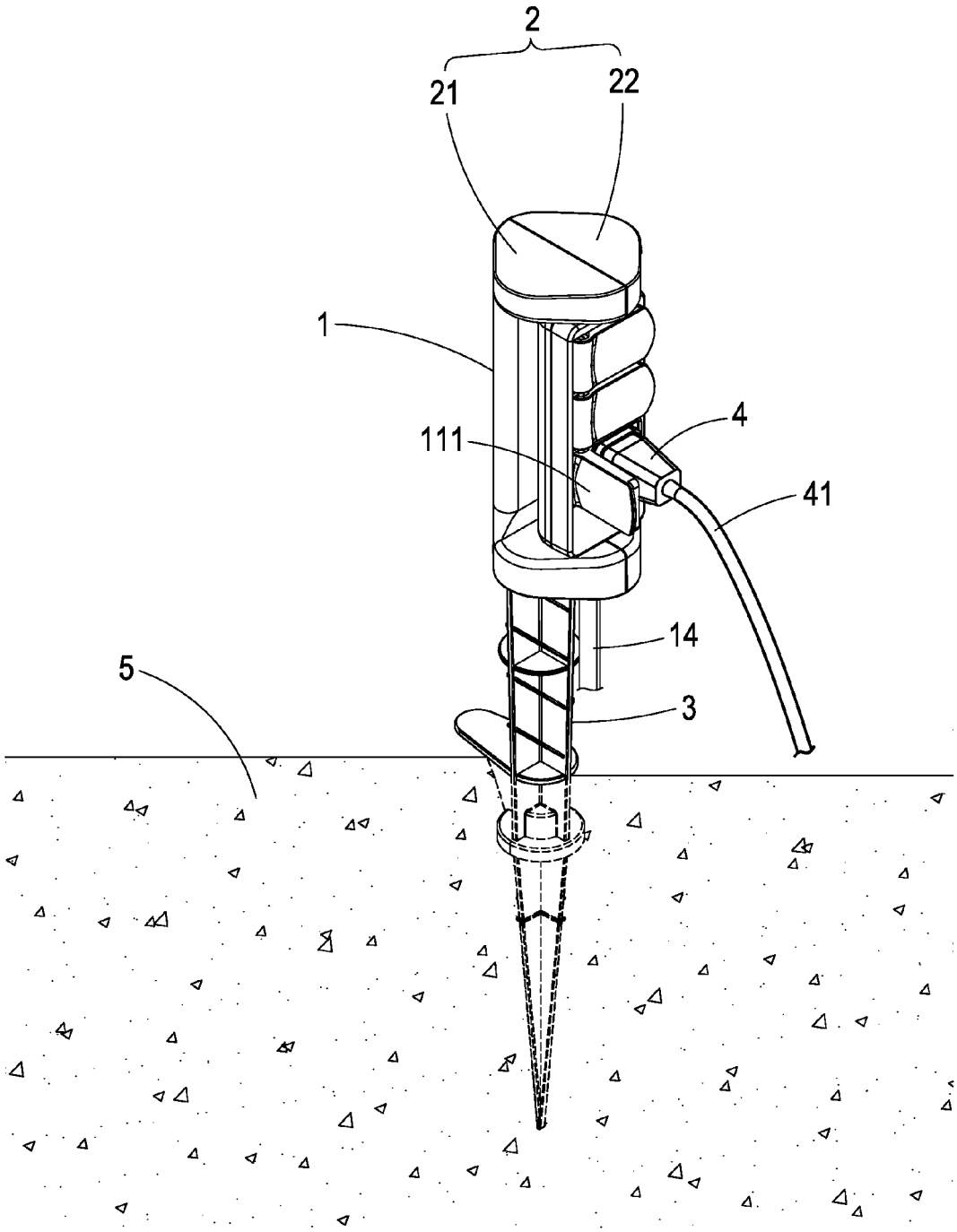
FIG. 7B shows a view for the rotation implementation of the power socket structure for outdoor electric extension line according to the present invention.

Moreover, from FIG. 7A, it can be seen that the cone 3 can be implanted into outdoor ground 5 so the fixation case 2 pivotally connected to the socket body 1 can be fixedly positioned for outdoor applications, since the cone 3 can hold the socket body 1 in fixation. Additionally, the Figure shows that a power plug 4 electrically connected to a product power line 41 has already been inserted into the power socket 11 of the socket body 1 (the other end of the product power line 41 not connected to the power plug 4 is electrically coupled to an electric product, not shown in the Figure); when the power plug 4 is moved, as shown in FIG. 7B, it will bring the socket body 1 to rotate so that the socket body 1 will not be entangled with the product power line 41 of the power plug 4. Besides, seeing that the power line 14 electrically connected to the socket body 1 rotates conjunctively with the socket body as well, when the socket body 1 rotates, possible twist or fracture issues on the internal conductive line of the power line 14 can be eliminated.

Figure 8:
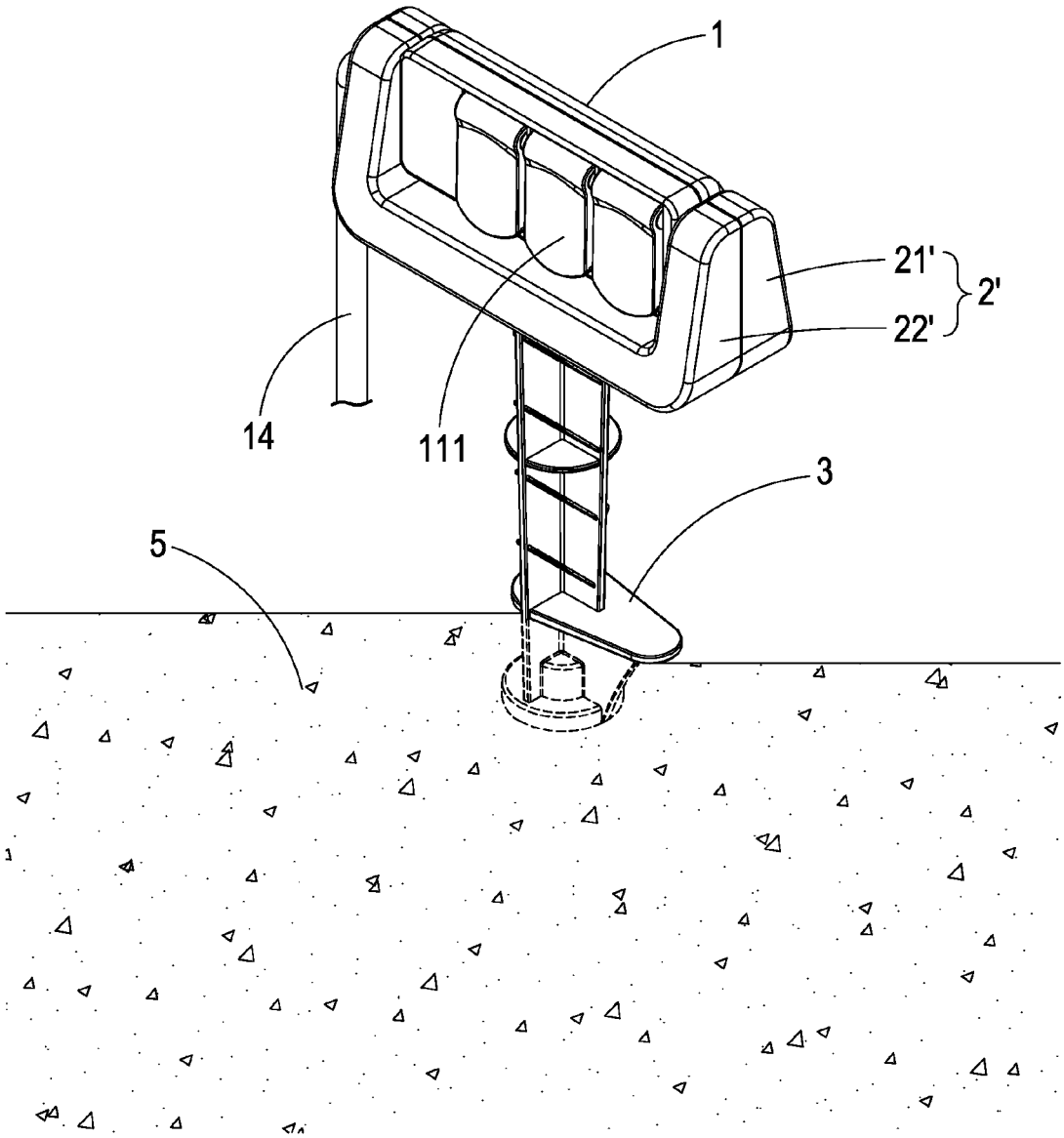
FIG. 8 shows a structure view for the second embodiment of the power socket structure for outdoor electric extension line according to the present invention.

From FIG. 8, it can be noted that, in addition to the bottoms of the first side case 21 and the second side case 22 in the fixation case 2, the half recess screw hole 216, 226 as set forth in the first embodiment can be also installed on the lateral edges of the first side case 21' and the second side case 22' in the fixation case 2'. Accordingly, as shown in FIG. 8, the socket body 1 and the fixation case 2' can be laterally disposed onto the cone 3 such that the cone 3 can be installed vertically to the power line of the socket body.

Compared with other conventional technologies, the power socket structure for outdoor electric extension line provided by the present invention further offers the following advantages:

1. The present invention allows, when the power line plug rotates, the extension line socket to rotate along with the rotation of the power line plug, thus preventing possible damages or even fracture problems on the internal conductive line thereof due to power line entanglement caused by repetitive rotations of the power line.

2. The extension line socket according to the present invention can be applied outdoors, such as in outdoor areas like a garden, a gravel land, a lawn and so forth.

Through the aforementioned detailed descriptions for the preferred embodiments according to the present invention, it is intended to better illustrate the characteristics and spirit of the present invention rather than restricting the scope of the present invention to the preferred embodiments disclosed in the previous texts. On the contrary, the objective is to encompass all changes and effectively equivalent arrangements within the scope of the present invention as delineated in the following claims of the present application.

What is claimed is:

1. A power socket structure for outdoor electric extension line, comprising:.

a socket body including one or more power sockets and a case;

a top of the case of the socket body having a first pivotal axis wherein the first pivotal axis comprising an edge the edge of the first pivotal axis being installed with a blocker;

a bottom of the case of the socket body having a hollow second pivotal axis wherein the hollow second pivotal axis having an edge the edge of the second pivotal axis being installed with a blocker a power line being electrically connected to the socket body and outputs electric power from the hollow second pivotal axis;

a fixation case including a first side case and a second side case, thus forming a recess positioning part through combining the first side case and the second side case;

the recess positioning part comprising a top surface and a bottom surface;

the top surface of the recess positioning part being installed with a pivotal connection hole the bottom surface being installed with a pivotal connection structure thereby allowing an integration with the socket body and being accommodated within the recess positioning part, such that the first pivotal axis of the socket body being pivotally connected to the pivotal connection hole on the top of the positioning part, and the second pivotal axis being pivotally connected to the pivotal connection structure on the bottom of the recess positioning part;

the socket body being in position through a blockage and a holding by the blocker on the edge of the first pivotal axis and the edge of the second pivotal axis allowing rotations each of sidewalls in the fixation case being installed with a screw hole; and a cone being joined by a screw via the screw hole in the fixation case maintaining the cone being located on a sidewall of the socket body, in which the cone is implanted into ground so that the fixation case pivotally connected with the socket body can be steadily positioned for outdoor applications.

2. The power socket structure for outdoor electric extension line according claim 1, wherein the first side case and the second side case both include a recess space forming the positioning part upon combining, and also the tops of the first side case and the second side case include a half recess pivotal connection orifice for forming the closed pivotal connection hole upon combining.

3. The power socket structure for outdoor electric extension line according to claim 2, wherein the blocker on the edge of the first pivotal axis presses against the outside of the pivotal connection orifice on the top of the first side case and the top of the second side case.

4. The power socket structure for outdoor electric extension line according to claim 1, wherein the surface on the second pivotal axis of the socket body includes one or more elastic plates, and the pivotal connection structure of the fixation case includes a recess/protrusion positioning surface; and the socket body being limited in position by the recess/protrusion positioning surface while rotating, thus allowing a segmental positioning feature.

5. The power socket structure for outdoor electric extension line according to claim 4, wherein both the first side case and the second side case having a recess space for forming the positioning part upon combining; and both the bottoms of the first side case and the second side case include a three-layered recess orifice structure for forming the pivotal connection structure upon combining, in which the three-layered recess orifice structure includes sequentially a first layer recess orifice structure, a second layer recess orifice structure as well as a third layer recess orifice structure, and the second layer recess orifice structure has at least one recess/protrusion positioning surface.

6. The power socket structure for outdoor electric extension line according to claim 5 wherein the blocker on the edge of the second pivotal axis presses against the inner side of the third layer recess orifice structure in the three-layered recess orifice structure on the bottom of the first side case and the bottom of the second side case.

7. The power socket structure for outdoor electric extension line according to claim 1, wherein the blocker of the second pivotal axis presses against and holds the inner side on the bottom of the pivotal connection structure;

at least a protrusion plate extends from the edge of the blocker on the second pivotal axis and the bottom of the pivotal connection structure includes at least a position-limiting part such that, upon the socket body rotating, the protrusion plate can be blocked by the position-limiting part so the rotation of the socket body is only allowed within a confined range.

8. The power socket structure for outdoor electric extension line according to claim 1, wherein each power socket on the socket body being installed with a protection lid covering the power socket.

* * * * *